US008050934B2

(12) United States Patent
Sakurai et al.

(10) Patent No.: US 8,050,934 B2
(45) Date of Patent: Nov. 1, 2011

(54) LOCAL PITCH CONTROL BASED ON SEAMLESS TIME SCALE MODIFICATION AND SYNCHRONIZED SAMPLING RATE CONVERSION

(75) Inventors: Atsuhiro Sakurai, Tsukuba (JP); Yoshihide Iwata, Ibaraki (JP); Steven D. Trautmann, Ibaraki (JP)

(73) Assignee: Texas Instruments Incorporated, Dallas, TX (US)

( * ) Notice: Subject to any disclaimer, the term of this patent is extended or adjusted under 35 U.S.C. 154(b) by 993 days.

(21) Appl. No.: 11/947,244

(22) Filed: Nov. 29, 2007

(65) Prior Publication Data

US 2009/0144064 A1 Jun. 4, 2009

(51) Int. Cl.
*G10L 21/04* (2006.01)

(52) U.S. Cl. ..... 704/503

(58) Field of Classification Search ..... 704/503
See application file for complete search history.

(56) References Cited

U.S. PATENT DOCUMENTS

| | | | | | |
|---|---|---|---|---|---|
| 5,175,769 | A * | 12/1992 | Hejna et al. | 704/211 |
| 5,641,927 | A * | 6/1997 | Pawate et al. | 84/609 |
| 5,928,313 | A * | 7/1999 | Thompson | 708/313 |
| 6,266,644 | B1 * | 7/2001 | Levine | 704/503 |
| 6,278,387 | B1 * | 8/2001 | Rayskiy | 341/61 |
| 6,718,309 | B1 * | 4/2004 | Selly | 704/503 |
| 6,801,898 | B1 * | 10/2004 | Koezuka | 704/500 |
| 6,842,735 | B1 * | 1/2005 | Covell et al. | 704/503 |
| 7,570,306 | B2 * | 8/2009 | Zhou et al. | 348/581 |
| 2003/0182106 | A1 * | 9/2003 | Bitzer et al. | 704/207 |
| 2004/0064576 | A1 * | 4/2004 | Goldhor et al. | 709/232 |
| 2004/0122662 | A1 * | 6/2004 | Crockett | 704/200.1 |
| 2004/0230421 | A1 * | 11/2004 | Cezanne et al. | 704/207 |
| 2007/0033057 | A1 * | 2/2007 | Covell et al. | 704/503 |
| 2007/0088558 | A1 * | 4/2007 | Vos et al. | 704/275 |
| 2008/0052068 | A1 * | 2/2008 | Aguilar et al. | 704/230 |
| 2010/0036658 | A1 * | 2/2010 | Son et al. | 704/222 |

OTHER PUBLICATIONS

Dorran et al., Time-scale modification of music using a subband approach based in the bark scale 2003, IEEE Workshop, pp. 173-176.*

Regalia et al., The digital all pass filter: A versatile signal processing building block 1988, IEEE, pp. 19-35.*

* cited by examiner

*Primary Examiner* — Jakieda Jackson

(74) *Attorney, Agent, or Firm* — Robert D. Marshall, Jr.; W. James Brady; Frederick J. Telecky, Jr.

(57) ABSTRACT

This invention locally controls the pitch of speech and audio signals. The invention is based on a seamless time scale modification (S-TSM) scheme connected to a synchronized sampling rate converter that switches between different time scale factors in a seamless manner and controls pitch during playback in a nearly continuous way.

5 Claims, 3 Drawing Sheets

LOCAL PITCH CONTROL BASED ON SEAMLESS TIME SCALE MODIFICATION AND SYNCHRONIZED SAMPLING RATE CONVERSION

TECHNICAL FIELD OF THE INVENTION

The technical field of this invention is recording and transmitting digital audio data.

BACKGROUND OF THE INVENTION

The prior art includes a variety of techniques and algorithms for improving the quality of digitally recorded and transmitted audio data. These techniques include altering audio pitch.

One prior art technique achieves pitch shifting by seamless time-scale modification (TSM) and restoration of the original time scale through sampling rate conversion. Pitch shifters embedded in karaoke systems use this principle permitting adjustment of the key of a song accompaniment to the singer's voice. Previous approaches to pitch conversion generally employ either: constant pitch shift of the entire signal as seen in common key-shifting algorithms; or complex algorithms that rely on manually labeled databases, speech production models and/or frequency domain processing.

SUMMARY OF THE INVENTION

The present invention locally controls the pitch of speech and audio signals. The invention uses seamless time scale modification (S-TSM) and a synchronized sampling rate converter that seamlessly switches between different time scale factors. Since the time scale can be adjusted in small steps and transitions between time scales occur seamlessly, this invention provides nearly continuous playback pitch control. The invention is useful in key shifting function in recording studios or karaoke equipment and it can control intonation or fundamental frequency in speech and music synthesis without requiring a speech production model or manual pitch marking.

BRIEF DESCRIPTION OF THE DRAWINGS

These and other aspects of this invention are illustrated in the drawings, in which.

DETAILED DESCRIPTION OF PREFERRED EMBODIMENTS

There are two common approaches to changing the fundamental frequency contour in speech synthesis systems. The first approach uses a speech production model. Voiced speech is approximated as the output of a vocal tract filter fed by an impulse train or another excitation signal source. Controlling the fundamental frequency is relatively straightforward, since it is dictated by the fundamental frequency of the source. However, such systems only work satisfactorily for signals containing pure speech that can be approximated by the model. The second approach is known as PSOLA (pitch-synchronous overlap-add). This approach first marks a speech database containing natural speech utterances. These marks indicate positions in the speech waveform corresponding to fundamental periods. Speech is synthesized by concatenating segments of speech extracted from the database. In order to change the fundamental frequency, distances between marks are changed and the waveform between the marks is warped accordingly. This method usually results in high quality, but pitch marking is a laborious process that cannot be executed automatically.

Figure 1:
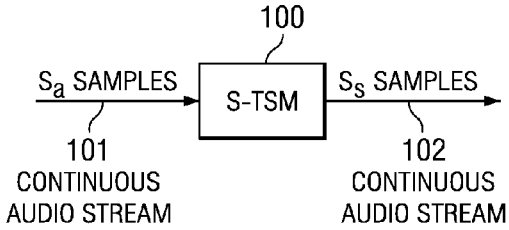
FIG. 1 illustrates the seamless time scale modification (S-TSM) of this invention continuously receiving input frames containing $S_a$ samples and generating output frames containing $S_s$ samples without changing the original pitch.

FIG. 1 illustrates seamless time scale modification (S-TSM) system 100. S-TSM 100 continuously receives input frames containing a continuous audio stream of $S_a$ samples 101 and generates output frames containing a continuous audio stream of $S_s$ samples 102 without changing the original pitch. These continuous audio streams include frames that are segments of $S_a$ and $S_s$ and can vary from frame to frame to cope with dynamic time scale changes during playback. If the input consists of a continuous audio stream, the output frames can be concatenated successively without audible artifacts at frame transitions.

Figure 2:
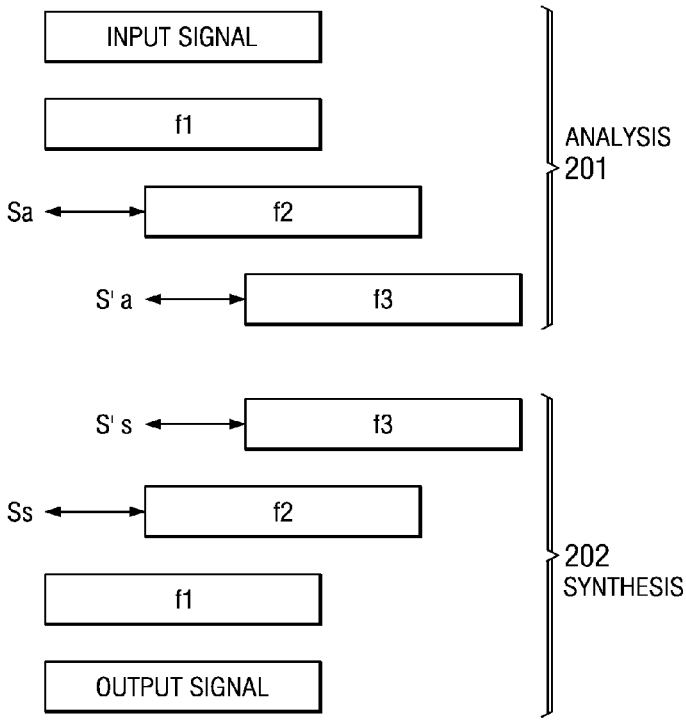
FIG. 2 illustrates an overview of S-TSM processing.

FIG. 2 illustrates the two basic steps involved in audio stream processing. In the analysis step 201, the input signal is subdivided into overlapping frames (f1, f2, f3. . .) separated by $S_a$ samples. Note that the larger the value of $S_a$, the smaller the amount of overlap between successive frames. In the synthesis step 202 the frames resulting from the analysis step are added using a different separation $S_s$ to obtain the output signal. Time scale is reduced when $S_s<S_a$ or increased when $S_s>S_a$.

Figure 3:
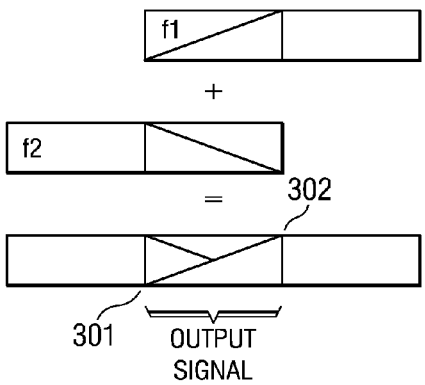
FIG. 3 illustrates the addition of overlapped frames with fade-in/fade-out windows.

The frame addition operation in synthesis step 202 requires prior multiplication of the frames by fade-in and fade-out window functions. FIG. 3 illustrates an example window function. The window function is valid in different forms but must assume the value 0 at the beginning of the overlapping region 301 and the value 1 at its end 302, and the sum of the fade-in and fade-out window values must always equal 1. FIG. 3 shows simple ramp functions that satisfy these properties.

In general, parameters $S_a$ and $S_s$ are set arbitrarily within certain limits in order to achieve the desired time scale modification. Referring back to FIG. 2, selecting $S_a$=1024 samples and $S_s$=512 samples reduces the time scale by half. This results in double speed for a sampled audio signal. In practice the value of $S_s$ must be fine-tuned in order to maximize phase coherence between the frames to be added.

Figure 4:
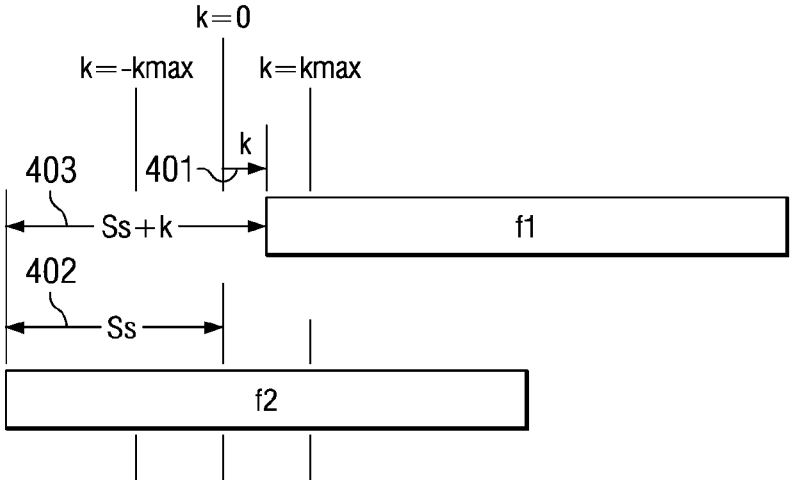
FIG. 4 illustrates the fine-tuning of the separation $S_s$ between output frames.

FIG. 4 illustrates this fine-tuning. An offset value k 401 is added to $S_s$ 402, resulting in the actual separation $S_s$+k 403 between output frames. An important part of the algorithm finds the optimal value of offset k that results in maximum coherence between the signal frames to be added.

Figure 5:
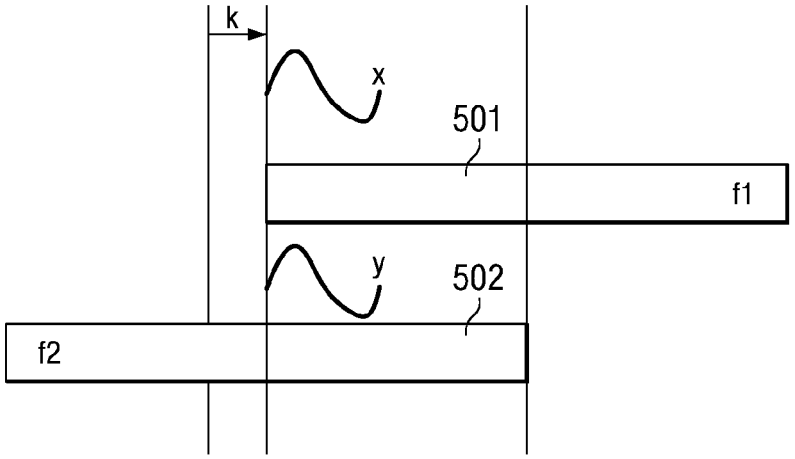
FIG. 5 illustrates the principle of determining optimal offset k.

FIG. 5 illustrates the process of optimizing k. Consider the regions where the two signal frames to be added overlap, indicated as x 501 and y 502. The optimal value of offset k is the one that results in maximum coherence between signals x 501 and y 502 by maximizing their similarity. For the example waveforms shown in the FIG. 5, it is clear that the particular value of k shown results indeed in maximum similarity. Mathematically, similarity can be approximated by a cross-correlation function. In this case, cross-correlation is evaluated for values of k from $-k_{max}$ to $k_{max}$ and the value that results in maximum cross-correlation is selected. Using cross-correlation or other functions as measures of signal similarity has been thoroughly studied in the literature.

The S-TSM algorithm of the present invention has the additional property that the desired parameters $S_a$ and $S_s$ can be changed in real-time without introducing audible artifacts. There is no discontinuity from frame to frame even when time scales $S_a$ and $S_s$ are changed. A buffering mechanism stores a past history of data and keeps track of the last selected value of k. The deviation from the desired value of $S_s$ by the amount k is always compensated in the following frame and an internal buffer exists as part of the S-TSM processing to absorb such deviations. As a consequence, the S-TSM algorithm always takes exactly the desired numbers of input and output samples regardless of the value of k.

In principle, $S_a$ and $S_s$ can assume any integer values within a certain range but it is convenient to predefine a set of values relating to desired time scale modification factors. Table 1 defines possible values of $S_a$ and $S_s$ that allow time scale modification factors of ⅝ (0.5x) to ⅛ (2.0x) based upon a sampling frequency of 48 kHz.

For musical applications a good choice appears to use time scales based on the musical scale covering 1 or 2 octaves of range. Other applications such as speech synthesis do not require such a wide range but finer gradation.

Note that in Table 1 the number of input samples $S_a$ is the same value of 1024 for all modes. The number of output sample $S_s$ varies from 512 to 2048 and is eventually restored to 1024 by the synchronized sampling rate converter, resulting in the desired pitch modification factor.

TABLE 1

| Time Scale Modification Factor | Input Buffer Size ($S_a$) | Output Buffer Size ($S_s$) |
|---|---|---|
| 4/8 | 1024 | 2048 |
| 5/8 | 1024 | 1638 |
| 6/8 | 1024 | 1365 |
| 7/8 | 1024 | 1170 |
| 8/8 | 1024 | 1024 |
| 9/8 | 1024 | 910 |
| 10/8 | 1024 | 820 |
| 11/8 | 1024 | 744 |
| 12/8 | 1024 | 682 |
| 13/8 | 1024 | 630 |
| 14/8 | 1024 | 586 |
| 15/8 | 1024 | 546 |
| 16/8 | 1024 | 512 |

The input and output buffer sizes of the S-TSM algorithm shown in Table 1 were conveniently selected to simplify the switching of the sampling rate conversion filter between different modification factors.

Figure 6:
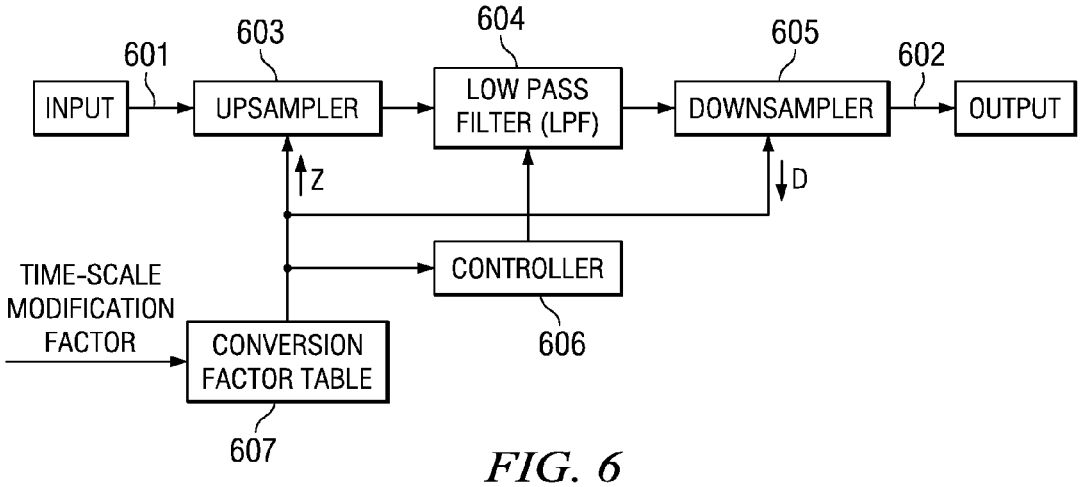
FIG. 6 illustrates a system based on Pythagorean tuning using small integer ratios.

FIG. 6 illustrates the general case of sampling rate conversion by a rational factor Z/D, where Z is the up-sampling factor and D is the down-sampling (decimation) factor. Input 601 is up-sampled by up-sampler 603. Low pass filter 604 filters the output of up-sampler 603. Down-sampler 605 down-samples the filtered signal producing output signal 602. Conversion factor table 607 determines the up-sampling factor Z and the down-sampling factor D dependent on the desired time-scale modification. Controller 606 controls the cut-off frequency of low pass filter 604 based on the factors selected by conversion factor table 607.

Sampling rate conversion must provide for seamless processing producing no audible artifacts from frame to frame due to transitions between different conversion factors. Use of an FIR (finite impulse response) filter easily satisfies this requirement as the low-pass filter with a delay line that encompasses the longest filter.

In the preferred embodiment the up-sampling factor varies from 4 to 16 while the down-sampling factor is always 8 as shown in Table 1. The cut-off frequency fc of low-pass filter 604 must correspond in the digital domain to the smallest value out of $\pi/8$ or $\pi/n$, where n ranges from 4 to 16. Care must be taken to maintain signal continuity upon filter switching by means of shared filter delay lines and filter gain compensation.

For a karaoke system, a larger number of sampling rate conversions based on a musical scale is desirable. Pythagorean tuning is based on similar small integer ratios. The system illustrated in FIG. 6 may used in this case. Most modern systems use an equal temperament musical scale based on the (irrational) twelfth root of two. In this case a direct interpolation method may be more advantageous than the equivalent up-sampling/down-sampling conversion based on a rational approximation. In either approach using a 1024 sample buffer for Sa and an integer size for Ss allows the pitch to be accurately shifted to within two cents (1/100th of a musical half-step) of any equal tempered musical interval within one octave up or down. If further accuracy is desired, a different value of Sa can be used with the corresponding best value of Ss.

Figure 7:
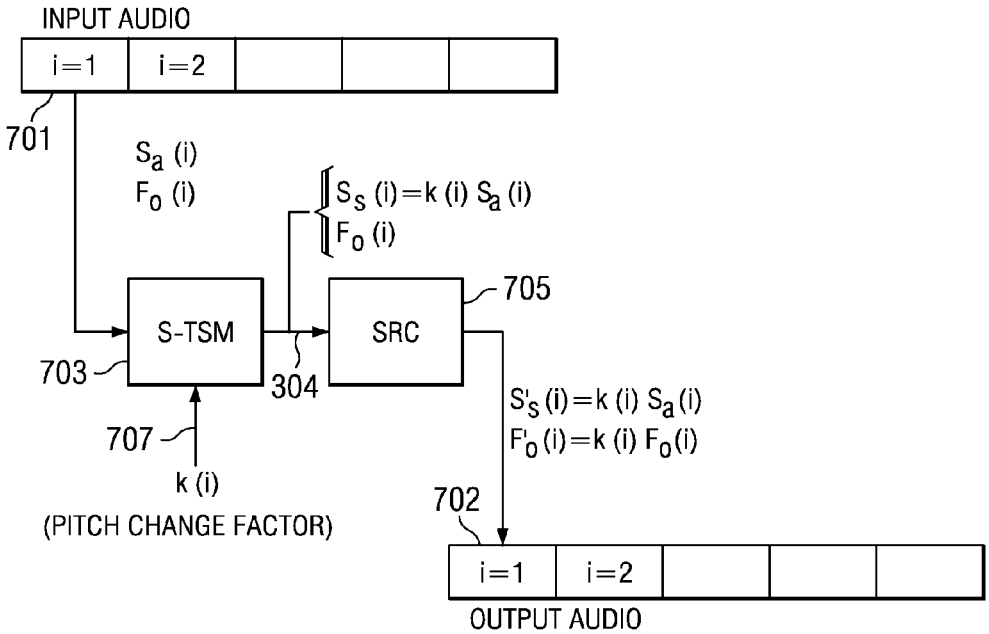
FIG. 7 illustrates a block diagram of the present invention.

FIG. 7 illustrates the block diagram of the pitch control system. The input audio stream 701 is split into frames numbered i=1, i=2 and so forth. $S_a(i)$ is the input frame size. In the preferred embodiment the frame size is set to the constant value of 1024 samples. $F_o(i)$ is the original value of the fundamental frequency and k(i) 707 is the pitch change factor that can be set for each frame. Pitch change factor k 707 is selected according to method illustrated in FIG. 5. S-TSM 703 outputs $S_s(i)$ samples, where $S_s(i)=k(i)*S_a(i)$. Sampling rate converter SRC 705 is synchronized with k(i) 707 and restores the original number of samples $S_a(i)$ by changing the fundamental frequency to $k(i)F_o(i)$. Note that a particular pitch change factor will remain constant for 1024 samples or 21 ms at a 48 kHz sampling rate. This is sufficiently short to be considered instantaneous for most applications.

What is claimed is:

1. A time-scale modification apparatus comprising:

an input for receiving an audio signal to be time-scale modified;

an up-sampler connected to said input for up-sampling said audio signal;

a low-pass filter connected to said up-sampler for low pass filtering said up-sampled audio signal;

a down sampler connected to said low-pass filter for down-sampling said low-pass filtered audio signal;

an input receiving a desired time-scale modification factor;

a conversion factor table receiving said time-scale modification factor and connected to said up-sampler and said down-sampler, said conversion factor table supplying an up-sampling factor Z to said up-sampler and a down-sampling factor D to said down-sampler dependent upon said time-scale modification factor; and a filter controller connected to said low pass filter and said conversion factor table operable to control a cut off frequency of said low pass filter dependent upon said up-sampling factor Z and said down-sampling factor D supplied dependent upon said time-scale modification factor.

2. The time-scale modification apparatus of claim 1, wherein:

said conversion factor table selects a fixed up-sampling factor Z for all time-scale modification factors and selected a variable down-sampling factor D dependent upon said time-scale modification factor.

3. The time-scale modification apparatus of claim 2, wherein:

said conversion factor table selects an up-sample factor Z of 8 independent of said time-scale modification factor and selects a down-sample factor D of 4 to 16 for a range of time scale modification factors between ½ and 2.

4. The time-scale modification apparatus of claim 2, wherein:

said up-sampler includes an input buffer having a fixed size for all time-scale modification factors; and said down-sampler includes an output buffer having a size dependent upon said time-scale modification factor.

5. The time-scale modification apparatus of claim 4, wherein:

said fixed size input buffer of said up-sampler stores 1024 samples; and said output buffer stores from 2048 to 512 samples for a range of time-scale modification factors between ½ and 2.

* * * * *